US005662420A

United States Patent [19]

Sinda et al.

[11] Patent Number: 5,662,420

[45] Date of Patent: Sep. 2, 1997

[54] CUSHIONED MACERATED PAPER DISPATCH PACKAGE

[75] Inventors: Edmund A. Sinda, Lake George; Mark D. Varney, Queensbury; Thomas G. Lozo, Glens Falls, all of N.Y.

[73] Assignee: Astro-Valcour, Incorporated, Glens Falls, N.Y.

[21] Appl. No.: 676,894

[22] Filed: Jul. 8, 1996

Related U.S. Application Data

[63] Continuation of Ser. No. 420,602, Apr. 12, 1995, abandoned.

[51] Int. Cl.[6] ..... B65D 30/14; B65D 81/03

[52] U.S. Cl. ..... 383/205; 383/109; 229/309; 206/521

[58] Field of Search ..... 383/205, 206, 383/84, 107, 109, 110; 229/309; 206/521

[56] References Cited

U.S. PATENT DOCUMENTS

| | | | |
|---|---|---|---|
| Re. 29,658 | 6/1978 | Rous . | |
| 914,274 | 3/1909 | Heyer . | |
| 1,942,917 | 1/1934 | d'Este et al. | 383/110 |
| 2,374,026 | 4/1945 | McKeen . | |
| 2,689,079 | 9/1954 | Timer | 383/84 X |
| 3,055,575 | 9/1962 | Gerard . | |
| 3,276,669 | 10/1966 | Vilutis . | |
| 3,349,990 | 10/1967 | Woodford . | |
| 3,372,861 | 3/1968 | Johnson et al. . | |
| 3,501,084 | 3/1970 | Harrison | 206/521 X |
| 3,592,380 | 7/1971 | Gerard . | |
| 4,087,002 | 5/1978 | Bambara et al. | 383/107 X |
| 4,108,351 | 8/1978 | Hough . | |
| 4,129,214 | 12/1978 | Gendron . | |
| 4,312,473 | 1/1982 | Hoeller . | |
| 4,535,930 | 8/1985 | Ward . | |
| 4,570,416 | 2/1986 | Schoenfeld . | |
| 4,580,683 | 4/1986 | Gochenour | 383/205 |
| 5,186,988 | 2/1993 | Dixon . | |
| 5,199,795 | 4/1993 | Russo et al. | 383/84 X |

FOREIGN PATENT DOCUMENTS

| | | | |
|---|---|---|---|
| 26 01 312 | 7/1976 | Germany | 206/521 |
| 1029870 | 5/1966 | United Kingdom . | |
| 2186253 | 8/1987 | United Kingdom . | |

*Primary Examiner*—Jes F. Pascua
*Attorney, Agent, or Firm*—Fisher, Christen & Sabol

[57] ABSTRACT

Flattened, padded, envelopes for dispatch packages, comprising a rectangular inner paper liner and a rectangular outer paper sheet and a rectangular thin layer of macerated paper positioned therebetween. The rectangular, macerated paper layer is of such a size that the edges thereof lie away from the edges of the inner paper liner and the outer paper sheet. The edges of the inner paper liner and the outer paper sheet are affixed together in a non-folded manner. The inner paper liner, the outer paper sheet and the macerated layer of paper are folded so as to form the rectangular envelope having a chamber for shipping material. The envelope has a front wall and a back wall. The two ends of the envelope are shorter than the top of the envelope. Each of the ends of the envelope are formed by the ends of the facing front wall and back wall of the envelope, which are affixed together in a non-folded manner. The front wall of the envelope extends beyond the back wall of the envelope so as to form a top flap. The top flap is foldable so as to overlap the top portion of the back wall. The inner top edge portion of the top flap has an adhesive layer longitudinally affixed thereon. A removable strip is positioned on the adhesive layer a tear strip is longitudinally affixed to the top fold below the adhesive layer. A tear tab is located at each end of the tear strip.

9 Claims, 5 Drawing Sheets

CUSHIONED MACERATED PAPER DISPATCH PACKAGE

This application is a continuation of prior U.S. application Ser. No. 08/420,602 filing date Apr. 12, 1995, now abandoned.

BACKGROUND OF THE INVENTION

1. Field Of The Invention

The invention relates to a new envelope of dispatch packages, particularly those for shipping materials which need protection during shipping.

2. Background Art

Several types of envelopes or pouches for dispatch packages are known.

One prior art envelope for dispatch packages is shown in FIGS. 1 and 2 of this specification.

By sandwiching macerated paper between two layers of kraft paper and through folding and gluing as described below, the cushioned paper dispatch package can be formed. This prior art dispatch package can be used inside of other protective packagings, or it can be used as a stand alone item. There are several problems with this type of dispatch package that are currently available, and such problems are enumerated and discussed below.

U.S. Pat. No. 3,055,575 (Gerard) discloses a flattened padded tubular bag construction having an inner paper liner and an outer paper sleeve and batting positioned therebetween. The liner and sleeve overlap at one side of the flattened bag construction and have a tear cord inserted inside of one of the side edges. The liner and the sleeve consist of rectangular paper sheets having a rectangular thin piece of batting positioned therebetween. The batting has substantially less width and length than the paper sheets so as to leave unpadded double ply paper portions when the combined liner batting and sleeve are folded into the tubular bag and overlapped longitudinally along one side of the tubular bag. The tear cord is adhesively attached to the inside face of the liner and extends longitudinally along the liner at an overlap double ply portion devoid of batting.

U.S. Pat. No. 3,276,669 (Vilutis) discloses a generally rectangular package of thermoplastic film, and a method of making same. At a minimum, the package includes a length of thermoplastic film folded substantially midway its ends so that a layer of film overlays each flat surface of the material of generally flat rectangular configuration and so that the fold is along one edge of the material. The juxtaposed surfaces along the other three sides of the material are sealed together. The package also includes a drawstring along one of the three sides between the layers of film and between the material and the adjacent sealed surfaces of the film. The ends of the drawstring are spaced from the respective edges of the folded film so that wicking due to the presence of the drawstring is prevented by the sealed portions of the surfaces at the ends of the drawstring.

U.S. Pat. No. 914,274 (Heyer) discloses an envelope which includes a blank of plastic paper stock. The blank includes a body with a sealing flap and a rectangular back. The back is folded over on the body, so that the opposite side edges of the body and the back are joined together by compression while the material of the blank is in a plastic state, so as to permit the edges to intermingle and unite in a homogeneous manner without the aid of adhesive material.

U.S. Pat. No. 2,374,026 (McKeen) discloses an envelope construction which includes two sheets of transparent material and a nontransparent paper backing. The two sheets of transparent material are fused together along three of their edges. The nontransparent paper backing is applied to the outer face of one of the sheets of transparent material. End user identification can be written or printed on the nontransparent paper backing. There are free closure flaps at the open end of the envelope receptacle created by the fusion of the two sheets of transparent material. The closure flaps can be folded over along the upper edge of the paper backing and sealed to the transparent material forming the back of the envelope structure.

U.S. Pat. No. 4,129,214 (Gendron) is an improvement patent which discloses an improved two compartmented envelope (which includes a small front compartment and a larger rear compartment). Gendron indicates that the prior art includes the following: a first generally rectangular blank defined by a rear panel and a front panel foldably attached to one another along a transverse fold line, a pair of side closure flaps foldably attached to the side edges of the rear panel and a top closure flap foldably attached to the upper transverse edge of the rear panel, and a second blank in the form of a patch adhered to the inside surface of the front panel. The Gendron improvement includes the following: There is a recess along the transverse edge of the front panel remote from the fold line connecting the front and rear panels, and a contoured extension along the transverse edge of the top closure flap for simultaneously sealing the first envelope compartment formed between the front panel and the patch and the second compartment formed between the rear panel and the patch. A perforated line in the top closure flap is located so as to separate the contoured extension of the top closure flap from the main portion thereof for permitting independent access to the first compartment without disturbing the contents of the second compartment. There is a pattern of adhesive applied to the top closure flap in the form of a centrally located strip that overlaps the perforated line and a pair of separate patches outboard of the centrally located strip whereby the centrally located adhesive strip simultaneously seals the first compartment and the central portion of the second compartment while the adhesive patches seal the outboard portions of the second compartment.

U.S. Pat. No. 4,108,351 (Hough) discloses an adhering method which includes, at a minimum, first and second overlying sheets of flexible material, the opposed surfaces of the sheets having bonded thereto a thermoplastic pile so that the internal surfaces of the envelope are pile surfaced, the other surfaces of the sheets being free of pile, the first sheet being of greater length than the second sheet so as to form a closure flap which can be folded into engagement with a cooperating portion of the other surface of the second sheet, and a layer of tack adhesive on the cooperating portion.

U.S. Pat. No. 4,312,473 (Hoeller) discloses a two-chamber envelope package which includes, at a minimum, a first and a second outer wall of equal length to one another, and a separating partition. The separating partition is disposed between the first and second outer walls and is joined together therewith in the edge areas thereof so that the partition is coextensive with the length of the outer walls. The separating partition is joined to the first outer wall by a first seam along its length at a predetermined distance from a first edge. The separating partition is joined to the second outer wall along its length by a second seam at a predetermined distance from a second edge located opposite of the first edge.

U.S. Pat. No. 4,535,930 (Ward) discloses an overnight letter envelope which includes, at a minimum, a continuous sheet of paper folded once around a fold line to form two panels, each of which has opposed inner surfaces, an outer surface, two lengthwise edges and two widthwise edges, and each of which have substantially the same width. One panel is shorter in length than the other panel (the so-called second panel). A pair of side panels is enclosed, each of which is joined to one of the lengthwise edges of the so-called first panel by a fold line, each of which has a lengthwise free edge, and each of which has a notch formed in the lengthwise free edge thereof. A flexible, transparent sheet which has two lengthwise edges and two widthwise edges is included and is superposed over a portion of the outer surface of the so-called second panel. The side panels are folded over and secured to the outer surface of the so-called second panel so that a major portion of the lengthwise edges of the flexible, transparent sheet are located between the outer surface of the so-called second panel and the side panels, and a minor portion of the lengthwise edges of the flexible transparent sheet is exposed at the notches. Means for securing the flexible transparent sheet in superposed position over the outer surface of the so-called second panel to form a pouch between the outer surface of the second panel and an inner surface of the flexible, transparent sheet are enclosed. The pouch is closed on three sides and has an opening located along a widthwise edge of the flexible, transparent sheet which has portions thereof adjacent to the notches. Means for effecting a seal between the outer surface of the so-called second panel and the inner surface of the flexible, transparent sheet are included adjacent to the widthwise edge of the flexible, transparent sheet. Finally, a flap is included which extends from a widthwise edge of the first panel and has means for effecting a seal between the first and second panels when desired.

U.S. Pat. No. 4,570,416 (Shoenfeld) discloses overnight packages, and a method of handling express envelopes. The envelope which is disclosed in Shoenfeld includes the following: a stiff paperboard backing and a film which is sealed around three edges of the backing thereby forming a pouch open at one end into which an envelope can be inserted; a pressure-sensitive adhesive on the free end of the film; and a sealable strip covering the pressure-sensitive adhesive. When the strip is removed, the free end can be applied to the open edge of the stiff backing to seal the envelope within the pouch.

U.S. Pat. No. Re. 29,658 (Rous) discloses a book carton with an improved opener which includes, at a minimum, parallel top and bottom walls which are foldably interconnected by a pair of parallel side walls to form a tubular structure including end flaps. A pair of hingedly connected tabs formed in the bottom wall of the carton are normally positioned perpendicular to the bottom wall. A notch is formed at one end of each of the end flap outer portions (i.e., notch on both sides). A closure flap attached to a side wall of the carton is normally coplanar with the end flap portions and parallel to the bottom wall. A tear strip formed in the top wall is normally located above the closure flap.

BROAD DESCRIPTION OF THE INVENTION

An object of the invention is to provide a new envelope for dispatch packages which avoid or overcome the herein-described problems and disadvantages of prior art dispatch envelopes described herein. Another object of the invention is to provide a padded shipping envelope which may be readily manufactured by mass production and which can be readily opened and which will be compact, durable and enable protected mailing or shipping of articles through the mails without damage thereto. A further object of the invention is to provide a method for producing the dispatch envelopes of the invention. Other objects and advantages of the invention are set out herein or are obvious herefrom to one skilled in the art.

The objects and advantages of the invention are achieved by the mailing pouches and the production method of the invention.

The invention involves flattened, padded, envelopes for dispatch packages, comprising a rectangular inner paper liner and a rectangular outer paper sheet and a rectangular layer of macerated paper positioned therebetween. The rectangular, macerated paper layer is of such a size that the edges thereof lie away from the edges of the inner paper liner and the outer paper sheet. The edges of the inner paper liner and the outer paper sheet are affixed together in a non-folded manner. The inner paper liner, the outer paper sheet and the macerated layer of paper are folded so as to form the rectangular envelope having a chamber for shipping material. The envelope has a front wall and a back wall. The two ends of the envelope are shorter than the top of the envelope. Each of the ends of the envelope are formed by the ends of the facing front wall and back wall of the envelope, which are affixed together in a nonfolded manner. The front wall of the envelope extends beyond the back wall of the envelope so as to form a top flap. The top flap is foldable so as to overlap the top portion of the back wall. The inner top edge portion of the top flap has an adhesive layer longitudinally affixed thereon. A removable strip is positioned on the adhesive layer so that the envelope is self-sealing. A tear strip is longitudinally affixed to the top fold below the adhesive layer so as to provide access into the envelope after it has been sealed. At least one tear tab is associated with the tear strip.

Preferably the top edge of the macerated paper layer located in the back portion of the envelope is sufficiently positioned below the top edge of the outer paper sheet and the inner paper liner so as to be below the edge of the top flap of the front portion of the envelope when the top flap is folded over the closed embodiment of the envelope. The feature allows the envelopes in a stack to be placed in one direction as shown in FIG. 8.

The tear strip is adhered to the top flap.

Preferably a curved, inwardly-facing notch (tear tabs) is located at either end of the top fold, each of the notches extending through the top flap thereby forming the tear tabs. A curved notch can be placed on both ends, or on one end or anywhere along the tear string, or a straight notch can only be placed on both ends.

Preferably the edges of the inner paper liner and the outer paper sheet are affixed together by means of a cold liquid glue or other adhesive. Preferably the ends of the front wall and the back wall of the envelope are affixed together by means of a cold liquid glue or other adhesive. Preferably the macerated paper layer is affixed to the inside surfaces of the inner liner and the outer sheet by means of a cold liquid glue or other adhesive.

Preferably the inner liner and the outer sheet are each constructed of kraft paper or other similar material. The outer kraft paper sheet serves as a protective layer from ribbing, etc., from external objects and the like, so it advantageously is of a higher weight and strength than the inner kraft paper sheet.

The invention also includes the method of constructing the invention envelopes.

DETAILED DESCRIPTION OF THE INVENTION AND THE DRAWINGS

This invention involves a new envelope for dispatch packages which provides protection from damage to the content thereof through the use of macerated paper, and also provides ease of use through the redefinition of the envelope form and layout.

Figure 1:
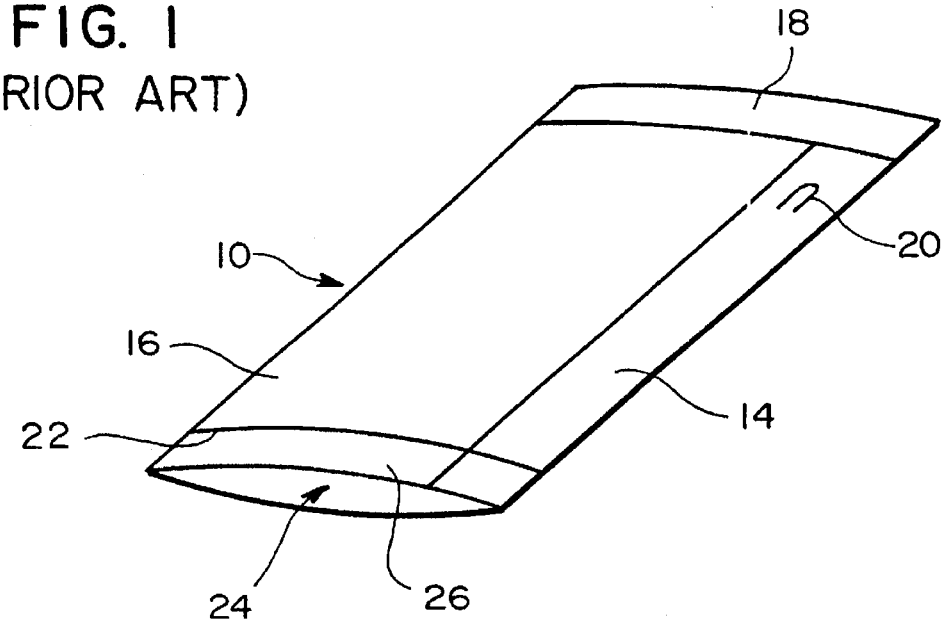
FIG. 1 (PRIOR ART)
FIG. 1 is a perspective view of a prior art padded dispatch envelope of tubular construction.

As the awareness of the need for recycling continues to develop, new outlets for refuse paper need to be developed, and existing outlets need to be expanded. One outlet of post consumer and post industrial paper is in providing protective packaging for consumer products. By sandwiching macerated paper between two layers of kraft paper or other material and through folding and gluing as described below, a cushioned paper dispatch package can be formed (see FIG. 1). This prior art dispatch package 10 can be used inside of other protective packagings, or it can be used as a stand alone item. In FIG. 1, prior art dispatch package 10 has longitudinal side flap 14 adhered to side wall 16. Bottom fold 18 forms the bottom closure for dispatch package 10. Folding score 22 allows, after material has been inserted in dispatch package 10 via top opening 24, the sealing of the top end of envelope 10 by folding over top fold portions 26 and adhering the walls together and to side wall 16. Tear tab 20 allows the opening of the side (longitudinal direction) edge of dispatch package 10 by means of using tear tab 20 to pull the tear strip.

As mentioned above, there are several problems with this type of dispatch package that are currently available. For one, the weight of the dispatch package is very high for the cushioning properties it exhibits. This is an added expense to the end user of this package since the cost of shipping is almost always directly related to package weight. Another drawback of this type of dispatch package is that it is very expensive to manufacture. Material costs of paper products continue to be on the rise. Still a third drawback of this type of dispatch package is that since the package is bulky and the opening to insert products is one of the smaller sides (an end) of the dispatch package, it is difficult to insert products into these packages without grossly oversizing the dispatch package in comparison to the packaged item. This again causes increased costs to be incurred by the end user. A fourth drawback is that the notch located near the longitudinal seam which provides access into the dispatch package to remove the product contained therein is currently available in either a right hand or left hand mode. This notch exposes the "tear" or "zip" string to the receiver of the dispatch package. It is impractical to think that each shipper would contact each receiver prior to shipping to find out if the receiver is right or left handed. Fifth, since there is a fold over the approximately one inch on the bottom seal, when placing these dispatch packages in a carton, they are stacked in groups of alternated tens. This is a drawback for the large volume user because if he/she was to try and automate his/her packaging stations, he/she would have to either remove and align all of the dispatch packages openings, or provide a system which could accommodate alternating opened sides. This second system would most likely have to be very sophisticated and expensive. All of these drawbacks have been addressed by the instant invention by designing a new cushioned macerated paper dispatch package which is described in detail below.

The currently available product 10 is formed by first unwinding two rolls of kraft paper (one outer layer, and one inner layer). Next the outer layer is printed for both product identification and end user identification if desired. These webs are then coated with a cold liquid glue. Prior to bringing these webs together, paper (usually comprised of mostly newsprint) is macerated, then formed into independent rectangles that can be sandwiched between the two coated kraft layers. This sandwich is then nipped to seal the macerated paper between the kraft layers. On this sandwiched layer, a "tear" or "zip" string tape is then applied. After it has been nipped onto the web, a curved notch 20 is then cut through both of the paper webs and also the "tear" string tape (see notch or tear tab 20 in FIG. 1). This string tape allows the receiver of the dispatch package to open this package and retrieve the contents thereof without puncturing the sandwiched macerated paper. This sandwiched web is then folded and glued along the longitudinal seam (see longitudinal seam 14 in FIG. 1) to form a continuous tube. Within this continuous tube, additional glue is applied when folding to form a bottom seal (see bottom seal 18 in FIG. 1).

This continuous tube is then cut by a knife which cuts the tube perpendicular to the travel thereof. At this time, individual tubes have been formed with the bottom already sealed. Now a final fold is placed on the dispatch package to provide strength in the bottom seal (see bottom fold 18 in FIG. 1). Approximately one inch is folded onto itself to seal the bottom. The currently available dispatch package is now complete.

Figure 2:
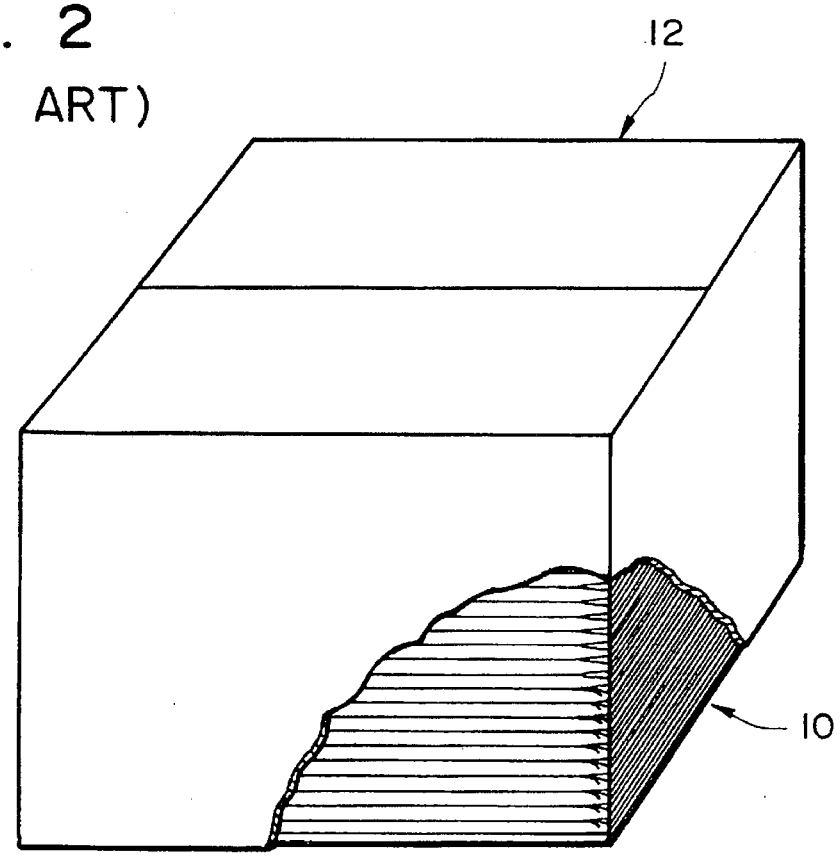
FIG. 2 (PRIOR ART)
FIG. 2 is a perspective view of a container, partially broken away, to show a stack (alternatingly placed) of the prior art dispatch envelopes of FIG. 1.

These prior art dispatch packages must then be stacked in a carton 12. Due to the one inch bottom seal fold over, these dispatch packages are stacked in groups of ten alternating the direction of the opening (see FIG. 2).

The new and improved macerated paper dispatch package design of the invention (see FIG. 3) is comprised of a few of the same steps as the currently available package, but only until the sandwich web is formed.

Again, first two rolls of kraft paper (one outer layer 48 and one inner layer 46) are unwound. Next the outer layer is printed for both product identification and end user identification if desired. These webs 46, 48 are then coated with a cold liquid glue or other adhesive. Prior to bringing these webs together, paper or fibrous material (usually composed of mostly newsprint) is macerated, then formed into independent rectangles 50 that can be sandwiched between the two coated kraft layers 46, 48. This sandwich is then nipped to seal the macerated paper between the kraft layers. On this sandwiched layer, a "tear" and "zip" string tape 38 is then applied. After it has been nipped onto the web, a straight notch 40 is then cut through both the paper webs (see straight notch 40 in FIG. 3) at both ends of the tear string tape, or a curved notch is cut through the paper and tear string tape. The straight notch tear string tape 38 is no longer cut by the notching procedure. Now the tear string tape 38 will be cut by the knife when the rest of the tube is cut. This "tear" or "zip" string 38 will allow the receiver of the dispatch package to open this package and retrieve it's contents without puncturing the sandwiched macerated paper. The major difference now is obtained when the dispatch package is used. The receiver may use either his/her right or left hand because the notch will be on both ends of the dispatch package unlike the currently available product which must be either right or left handed pull to open the package. This sandwiched web is then again folded but not glued along the longitudinal seam. Instead, now a pressure sensitive adhesive will be applied, and a release liner will then be applied over this adhesive (see release liner 44 in FIG. 3). This adhesive and release liner 44 provides the packager to seal this dispatch package with great ease prior to shipment. This longitudinal seam which was glued shut in the currently available dispatch package will be left open providing for the enlarged opening to insert the item to be shipped (see dispatch package opening 56 in FIG. 3). However, now within this unsealed continuous tube, substantially more additional glue is applied prior to folding, to form two side seals 36 when the dispatch package is complete (see side seal 36 in FIG. 3). Also note that the internal dimensions of the currently available dispatch package 10 and also the newly designed dispatch package 28 are identical to comply with the industry standards. However, because there is no one inch bottom fold, and the side seals are smaller in width, there is a material savings of outer and inner layers per dispatch package. Not only does this reduce manufacturing costs, it also decreases the weight of the dispatch package thus saving the end user shipping costs.

Figure 9:
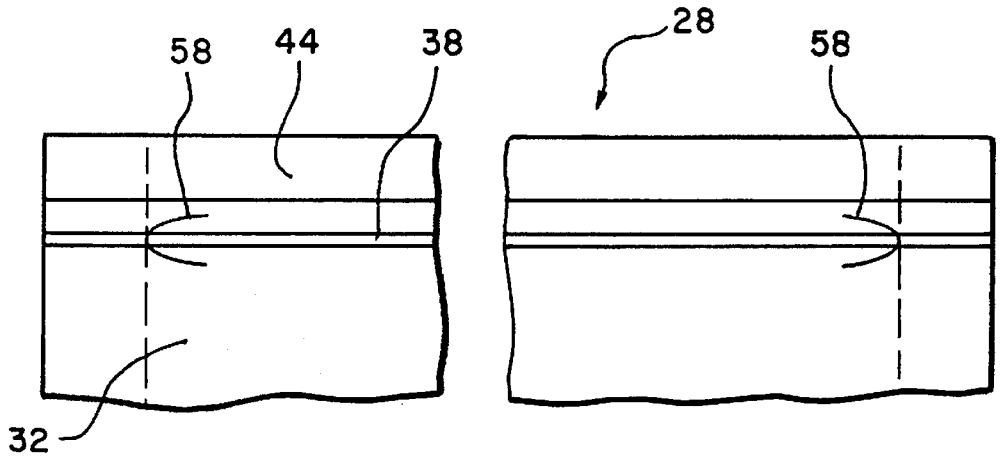
FIG. 9 is a partial view showing the closure flap of a variation of the closure flap shown in FIG. 4.

The unsealed continuous tube is then cut by a knife which cuts the tube perpendicular to its line of travel. At this time, unlike the currently available dispatch package, the newly designed dispatch packages 28 have been formed and are complete. They can now be placed in a carton 30. As previously stated, this new dispatch package does not have a folded bottom seal. Because of this, the packages do not have to be alternated when cartoned, therefore allowing all of the dispatch package openings to be located in the same direction (see FIG. 4). This will allow a greater ease in set up for the large volume user, and also easier automation if they so choose. Note the smaller dispatch packages are case packed with multiple stacks. These multiple stacks also will not have to be alternated in groups of ten. FIG. 9 shows a variation of the closure flap shown in FIG. 4. There are two inward-facing U-shaped tear taps (58), which are located at the end edges of the macerated paper layer.

Figure 3:
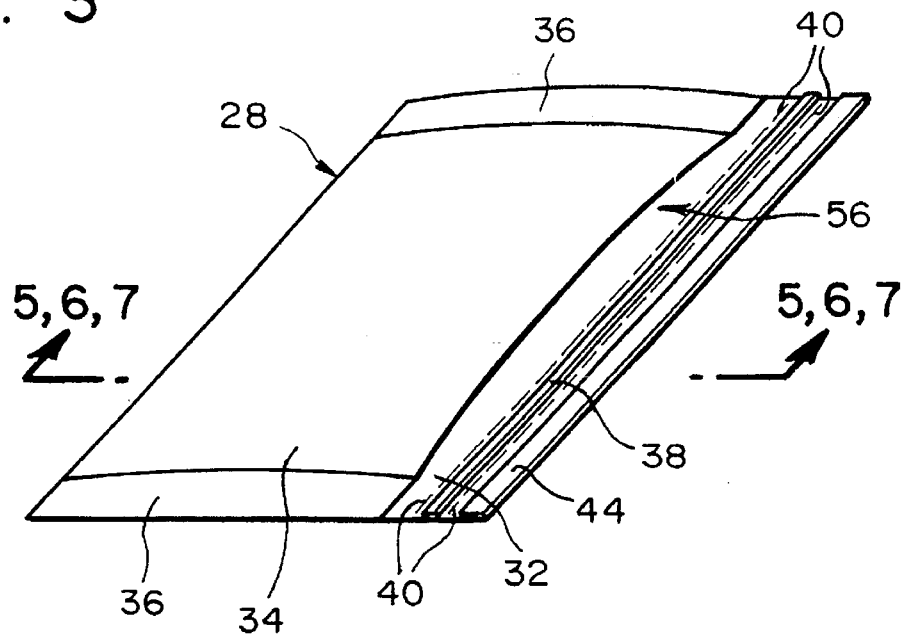
FIG. 3 is a perspective view of one embodiment of the invention padded envelope for dispatch packages.
Figure 10:
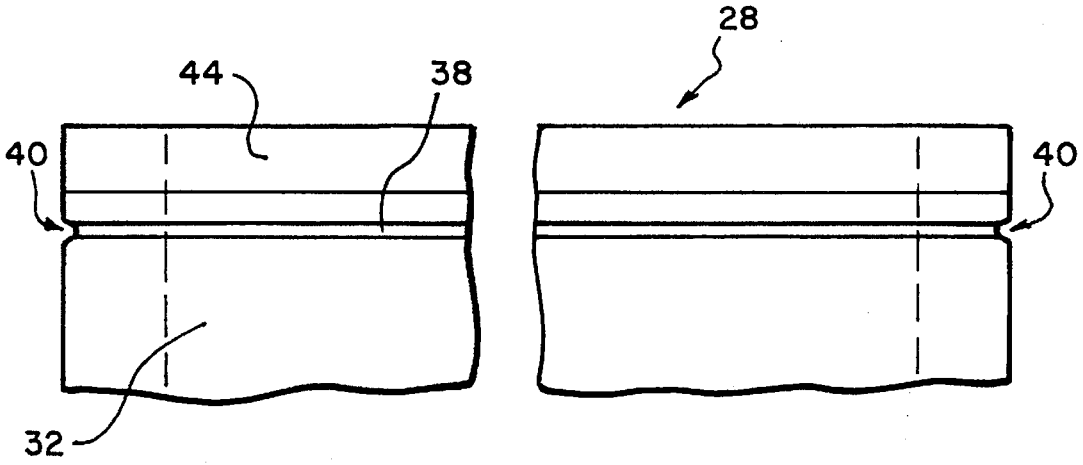
FIG. 10 is a partial view showing an embodiment of the invention padded envelope having notches at both ends.

In FIG. 3, dispatch package 28 has back wall 34 and a front wall, and end seals 36. Top flap 32, on its inside surface, has longitudinal adhesive layer 42 and removable cover layer 44 thereon. Tear strip 38 lies below layer 42 on the inside surface of top flap 32. Notches 40 lie at the ends of tear strip 40 or as in FIG. 4. Once material has been put into envelope 28 via opening 56, cover layer 44 is removed and top flap 32 is folded over to close and seal envelope 32. See FIGS. 5 and 6. To open sealed envelope 28, one of tear tabs or notches 40 is used to pull on tear strip 38. See FIG. 7 and FIG. 10.

Figure 5:
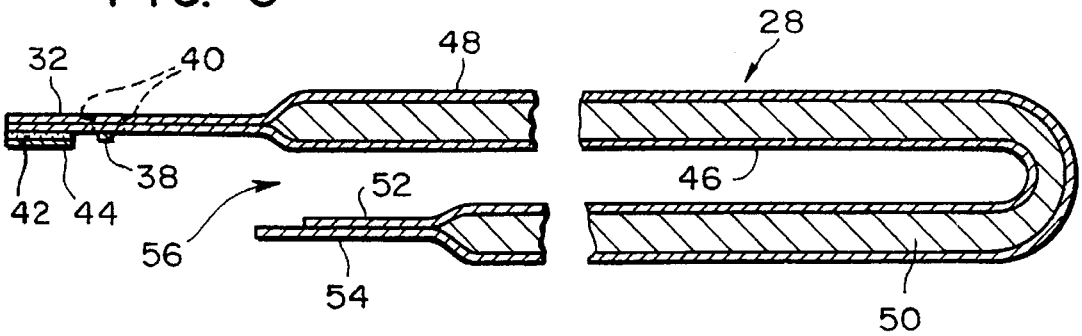
FIG. 5 is a lateral cross-sectional view along line 5—5 in FIG. 3 of the padded dispatch envelope in the open position.
Figure 6:
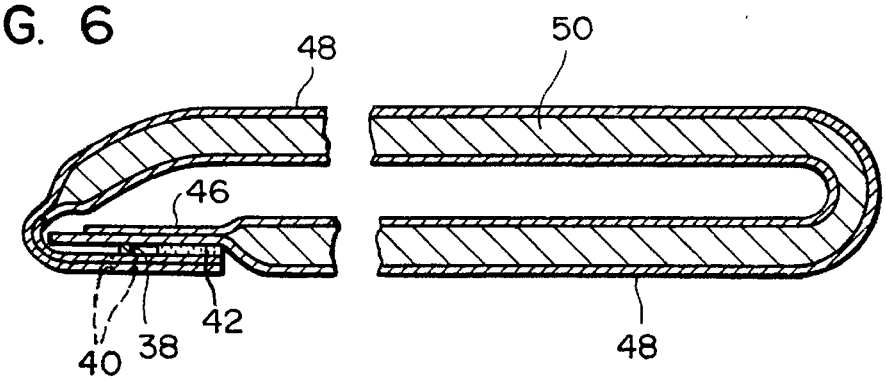
FIG. 6 is a lateral cross-sectional view along line 6—6 in FIG. 3 of the padded dispatch envelope in the closed position.
Figure 7:
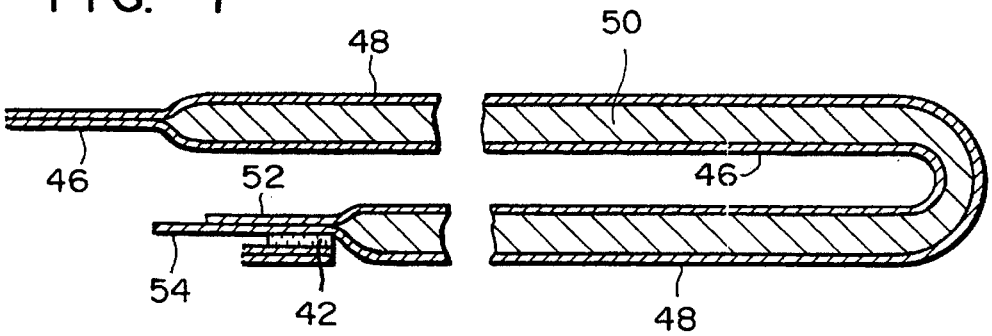
FIG. 7 is a lateral cross-sectional view along line 7—7 in FIG. 3 of the padded dispatch envelope in the reopened position.
Figure 8:
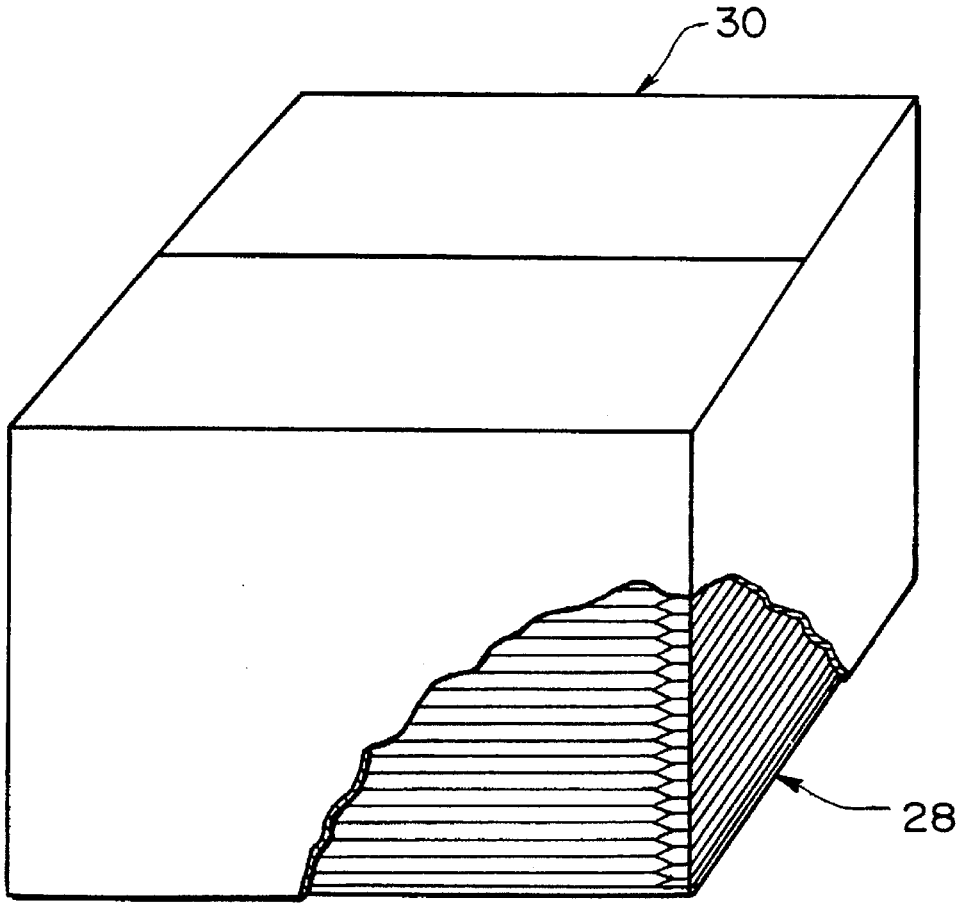
FIG. 8 is a perspective view of a container, partially broken away, to show a stack of the invention dispatch envelopes of FIG. 3 (non-alternating stack)

In FIGS. 5 to 7, note inner liner 46, outer sheet 48 and macerated paper layer 50.

The invention advantageously provides the end user with a more user-friendly product which is also more cost effective to both the manufacturer and also the end user.

The newly designed dispatch package addresses all of the previously listed problems exhibited in the currently available product. They are summarized as follows:

1. The weight of the old design is high for the cushioning properties it exhibits. The new design uses less raw materials for a better product, therefore the range between cushioning properties and required weight has been decreased.
2. The currently available dispatch package is expensive to manufacture. The new design is comprised of less steps to complete the dispatch package. Since there is both less time and less material to manufacture a better product, manufacturing costs will decrease.
3. The currently available dispatch package is bulky, and the only area to insert products is on one of the smaller sides. This makes inserting products into the dispatch package difficult and often requiring the dispatch package to be grossly oversized. The newly designed dispatch package has the opening to insert products as one of its major sides. This allows greater ease in inserting products to be shipped. Now a correctly sized dispatch package can be used instead of oversizing.
4. The currently available dispatch package has a notch which can be made for either right or left hand product removal. the newly designed dispatch package has a straight notch or left or right hand notch which will allow ease of product removal by both a right or left handed recipient.
5. The currently available dispatch package has a one inch bottom fold required to complete the package. This requires the alternating of stacks of ten when placing these dispatch packages in cartons. The newly designed dispatch package does not have a bottom fold. This allows all of the dispatch packages to be placed in a carton with their openings in one direction, allowing faster packaging for large volume users along with the ease of automation if so desired.

While it is preferable to use macerated paper as the cushioning material, the scope of the invention allows the use of other cushioning material such as batting in place of the macerated papers.

Figure 4:
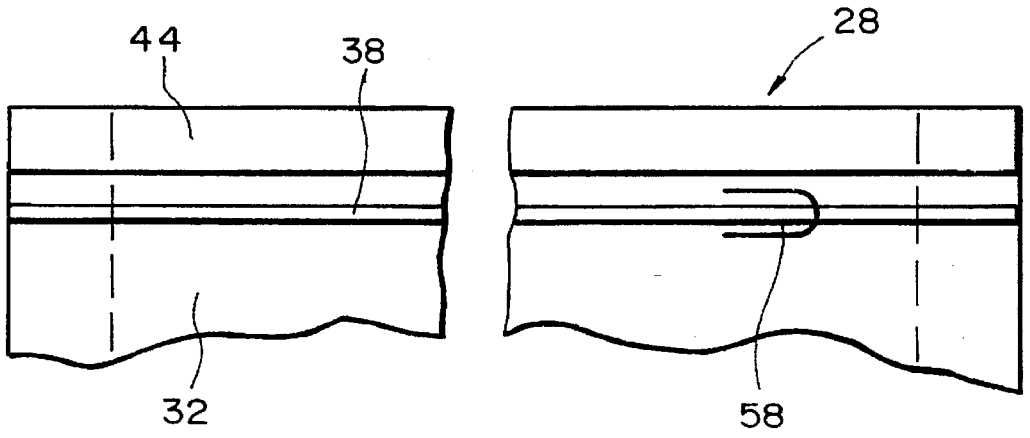
FIG. 4 is a partial view of the closure flap of another embodiment of the invention padded envelope for dispatch envelopes.

FIG. 4 shows a variation of the invention envelope which only has one tear notch or tab 58 and it is cut through the top flap and the tear strip. It is U-shaped.

LIST OF PARTS AND NUMERALS

In the drawings and the specification, the following list of the name of the parts of the invention (and the prior art) and the numeral associated with the parts are noted:

Numeral

10 Prior Art envelope

12 Container for prior art envelope 10

14 Side flaps

16 Side wall

18 Bottom seal/fold
20 Tear tab
22 Folding score
24 Prior art envelope opening
26 Top fold portions
28 Invention envelope
30 Container for invention envelopes 28
32 Top flap
34 Back wall
36 Envelope side edges/seals
38 Tear strip
40 Tear tab or notch
42 Adhesive layer
44 Removable cover layer
46 Inner paper liner
48 Outer paper sheet
50 Macerated paper layer
52 Back edge portion of liner 46
54 Back edge portion of sheet 48
56 Envelope opening
58 Tear tab

What is claimed is:

1. A flattened, padded envelope for dispatch packages, comprising a rectangular inner paper liner having end portions and a rectangular outer paper sheet having ends having outer portions and a rectangular layer of macerated paper positioned therebetween, said rectangular, macerated paper layer being of such a size that the edges thereof lie away from the edges of said inner paper liner and said outer paper sheet, edge portions of ends of said inner paper liner and said outer paper sheet being affixed together said inner paper liner, said outer paper sheet and said macerated layer of paper being folded so as to form said rectangular envelope having a chamber for shipping material, said envelope thereby having a front wall and a back wall and a bottom and a top, and having facing front wall and back wall, two ends of said facing front wall and said back wall having edge portions, two ends of said envelope being formed by the edge portions of the ends of said facing front wall and back wall of said envelope which are affixed together, the two ends of said envelope being shorter than the top of said envelope, the outer portions of the ends of said outer sheet, which are affixed to the end portions of said inner paper liner, not being folded over so as to contact or be affixed to any other portions of said outer paper sheet, said front wall of said envelope extending beyond said back wall of said envelope so as to form a top flap, said top flap being foldable so as to overlap the top portion of said back wall to form a top fold, the inner top edge portion of said top flap having an adhesive layer longitudinally affixed thereon, a removable strip being positioned on said adhesive layer and a tear strip being longitudinally affixed to said top fold below said adhesive layer.

2. The padded envelope of claim 1 wherein the top edge of said macerated paper layer located in the back wall of said envelope is sufficiently positioned below the top edge of said outer paper sheet and said inner paper liner so as to be below the edge of said top flap of the front wall of said envelope when said top flap is folded over in the closed embodiment of said envelope.

3. The padded envelope of claim 1 wherein said tear strip is a strip of nylon or other plastic adhered to said top flap.

4. The padded envelope of claim 1 wherein a curved, inwardly-facing notch is located at each end of said top flap, each of said notches extending through said top flap.

5. The padded envelope of claim 1 wherein a curved notch is located in said top fold at one of the end edges of said macerated paper layer, said notch extending through said top layer and said tear strip.

6. The padded envelope of claim 1 wherein the edges of said inner paper liner and said outer paper sheet are affixed together by means of a cold liquid glue or other adhesive.

7. The padded envelope of claim 1 wherein the ends of said front wall and said back wall of said envelope are affixed together by means of a cold liquid glue or other adhesive.

8. The padded envelope of claim 1 wherein the macerated paper layer is affixed to the inside surfaces of said inner liner and said outer sheet by means of a cold liquid glue or other adhesive.

9. The padded envelope of claim 1 wherein said inner liner and said outer sheet are each constructed of kraft paper or other web material.

* * * * *